United States Patent [19]

Häfele et al.

[11] Patent Number: 4,526,149

[45] Date of Patent: Jul. 2, 1985

[54] FUEL INJECTION APPARATUS FOR INTERNAL COMBUSTION ENGINES

[75] Inventors: Walter Häfele, Fellback, Fed. Rep. of Germany; Helmut Pfeifle, Ecally, France; Reinhard Schwartz; Max Straubel, both of Stuttgart, Fed. Rep. of Germany

[73] Assignee: Robert Bosch GmbH, Stuttgart, Fed. Rep. of Germany

[21] Appl. No.: 585,042

[22] Filed: Mar. 1, 1984

[30] Foreign Application Priority Data

Mar. 5, 1983 [DE] Fed. Rep. of Germany ..... 3307826

[51] Int. Cl.[3] ..... F02M 39/00

[52] U.S. Cl. ..... 123/447; 123/458; 123/357; 417/494

[58] Field of Search ..... 123/446, 447, 458, 495, 123/500, 501, 502, 357, 509, 506; 417/540, 542, 494, 499; 239/88-95, 585

[56] References Cited

U.S. PATENT DOCUMENTS

| | | | |
|---|---|---|---|
| 1,993,759 | 3/1935 | Stockmeyer | 417/494 |
| 2,739,643 | 3/1956 | Voit | 417/494 |
| 3,663,123 | 5/1972 | Fenne | 417/284 |
| 3,677,256 | 7/1972 | R'egneault | 123/506 |
| 3,699,939 | 10/1972 | Eckert et al. | 123/506 |
| 4,073,275 | 2/1978 | Hofer | 417/494 |
| 4,118,156 | 10/1978 | Ivosevic | 417/494 |
| 4,378,775 | 4/1983 | Straubel et al. | 123/458 |
| 4,426,198 | 1/1984 | Bastenhof et al. | 417/494 |
| 4,461,259 | 7/1984 | Roca-Nierga | 123/506 |

FOREIGN PATENT DOCUMENTS

| | | | |
|---|---|---|---|
| 139726 | 12/1934 | Fed. Rep. of Germany | 123/506 |
| 151228 | 11/1981 | Japan | 123/458 |
| 468958 | 7/1937 | United Kingdom | 123/447 |

*Primary Examiner*—Carl Stuart Miller

*Attorney, Agent, or Firm*—Edwin E. Greigg

[57] ABSTRACT

The fuel injection quantity of a fuel injection apparatus provided with a fuel injection pump is electrically regulated by means of the opening duration of a metering valve. Additionally, a shift in the instant of supply onset controlled in accordance with operating characteristics is attained by means of a change in the return-flow fuel quantity, which is diverted into a refill reservoir and then refilled completely into the pump work chamber by the beginning of the next subsequent injection stroke. Serving as the sole connection between the refill reservoir and a pump work chamber is an overflow conduit, the overflow opening of which, located at the discharge location into the pump work chamber, is opened by two control locations on the pump piston at the end of supply and once again shortly before bottom dead center. The two control locations are embodied by an oblique control edge on the pump piston that determines the end of supply and by a horizontal, end-face control edge, with the horizontal control edge assuring that shortly before bottom dead center any remnant quantity of the return-flow fuel still remaining in the refill reservoir is refilled back into the pump work chamber.

16 Claims, 13 Drawing Figures

FUEL INJECTION APPARATUS FOR INTERNAL COMBUSTION ENGINES

BACKGROUND OF THE INVENTION

The invention is based on a fuel injection apparatus for internal combustion engines. In a fuel injection apparatus of this kind known from German Offenlegungsschrift No. 31 18 669, the fuel injection quantity that has been pre-stored in a pump work chamber is determined by the duration of the opening period of an electronically actuatable metering valve, and a shift in the instant of supply onset is attained, and controlled in accordance with operating characteristics, by means of a variation in the return-flow fuel quantity. This return-flow fuel quantity is adjustable by means of the controlled rotational position of the pump piston, which is provided with an oblique control edge, and in any event the pump work chamber is refilled prior to the next subsequent injection stroke. The refilling process is reinforced by a fuel reservoir that is connectable with the pump work chamber. Because of the variable volume of the fuel during its diversion and refilling, and because each operation takes place at a completely different pressure level, influences on the onset of injection and on the supply quality arise in the known fuel injection apparatus which must be compensated for in the electric control unit by mean of appropriate correction values. It is thus an object of the invention to improve the fuel injection apparatus such that the variable fuel volume during diversion and refilling does not have a disadvantageous effect on the accuracy of the controlled fuel injection quantity and the instant of supply onset.

OBJECT AND SUMMARY OF THE INVENTION

In the fuel injection apparatus according to the invention, the return-flow fuel quantity diverted upon the end of supply is accurately refilled back into the pump work chamber, thereby precluding scattering in the supply quantity values and deviations in the instant of supply onset or at least reducing them to a value that is within the allowable tolerance. The metering pulse of the electric control unit that determines the opening duration of the metering valve thus results in an unequivocal supply quantity signal which is evaluatable in the regulating circuit of the control unit. A very substantial contribution to this improvement in function is made by the simplified conduit design, with the overflow conduit representing the sole and direct connection between the refill reservoir and the pump work chamber, and by means of the overflow opening that is opened up by both control locations of the pump piston, whatever fuel quantity still remains in the refill reservoir after the closure of the overflow opening by the first control location is refilled back into the pump work chamber each time the pump piston is at bottom dead center.

By means of the characteristics disclosed, advantageous embodiments and further developments of the fuel injection apparatus disclosed are possible. For instance, in a fuel injection apparatus embodied in accordance with the teaching herein, the remnant quantity of return-flow fuel remaining in the refill reservoir is refilled back into the pump work chamber, so that even at different engine speeds the refilling takes place substantially under the same pressure conditions and a suction effect generated by the pump piston during its return stroke does not have a disadvantageous effect on the fill status inside the overflow conduit and refill reservoir.

Although a large volume reservoir is also conceivable as the refill reservoir, accurate and repeatable fuel injection quantities and return-flow quantities are attained by using the piston reservoir as shown.

In a fuel injection apparatus as generally defined, in which the fuel injection pump is provided, as known from the patent cited above, with a cylinder liner containing the pump cylinder and fastened in the pump housing and with an overflow bore in the wall of the cylinder line that embodies at least a substantial portion of the overflow conduit, the optimal length of the overflow bore is defined by a minimum wall thickness on the part of the cylinder line such as to preclude any deformation of the cylinder liner. Especially in series injection pumps, in order to enable a relative position on the part of the two control locations axially offset from one another on the pump piston that is uniform in all the pumping elements of a pump with respect to the overflow opening, the cylinder liner, provided for instance with a fastening flange, must be slightly rotatable and may also be adjustable in the relative height of its position. In order that despite this adjustability of the cylinder liner the connection of the refill reservoir can be satisfactorily sealed. This reservoir is connected to the overflow bore by means of a connecting part at least partially encompassing the cylinder line. In accordance with the specialized embodiments shown herein, this connecting part comprises a slide shoe resting in a positively engaged manner on a cylindrical jacket face of the cylinder liner. This slide shoe simultaneously receives the essential structural parts of the refill reservoir. Further advantageous embodiments of the connecting part for the refill reservoir are disclosed herein.

In a fuel injection apparatus, all sealing and fastening problems are eliminated by building in the refill reservoir in an integrated manner an appropriate adaptation of the cam drive, it is possible to use merely one metering valve per two pumping elements.

The invention will be better understood and further objects and advantages thereof will become more apparent from the ensuing detailed description of four preferred embodiments taken in conjunction with the drawings.

DESCRIPTION OF THE PREFERRED EMBODIMENTS

Figure 1:
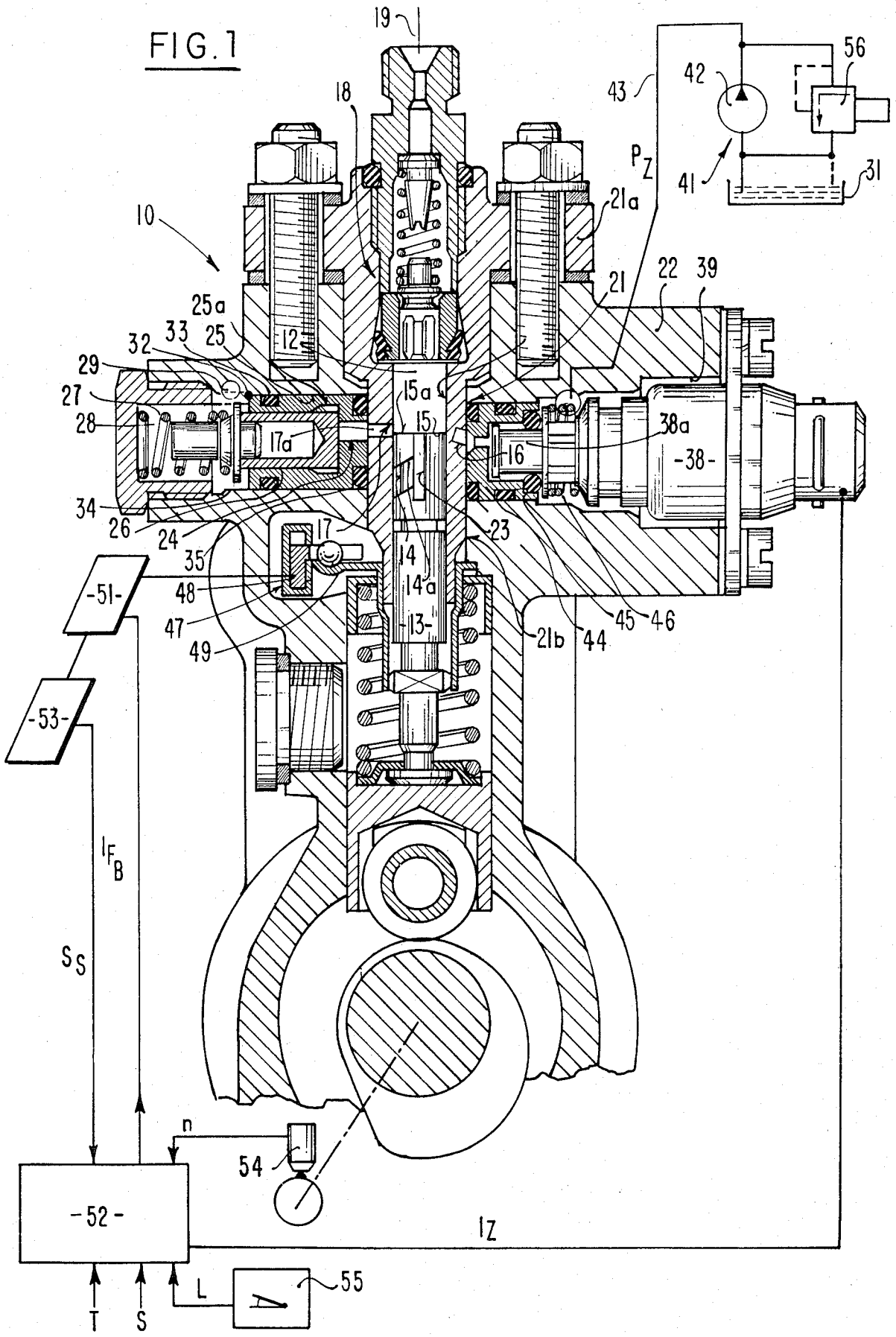
FIG. 1 is a simplified illustration of the first exemplary embodiment of a fuel injection apparatus according to the invention, having a fuel injection pump embodied as a series injection pump and shown partially in cross section.

FIG. 1 shows, as a first and preferred exemplary embodiment, a fuel injection pump 10 embodied as a series injection pump, which is shown in a partial cross-sectional view taken through a pumping element and has a pump piston 13 which is guided such as to be both axially and rotationally movable in a pump cylinder 11 and which defines a pump work chamber 12. The pump piston 13 has two control locations on its jacket face, of which one comprises an oblique control edge 14*a* of a recess 14, the control edge 14*a* being inclined relative to the longitudinal axis of the pump piston 13, and the other control location comprises a horizontal control edge 15*a* embodied by the end face 15 of the pump piston 15.

In the bottom dead center position (marked UT in the drawings) of the pump piston 13, an inflow opening 16, which is closed by the jacket face of the pump piston 13 during pump supply, and a diametrically opposed overflow opening 17*a* of an overflow bore 17 discharge into the pump work chamber 12, which is closable in the supply direction by a pressure valve 18 and is connectable via a pressure line 19, merely suggested in the drawing, with an injection nozzle, not shown.

The pump cylinder 11, in the exemplary embodiment shown in FIG. 1, is embodied as a cylindrical bore of a cylinder liner 21 provided with a fastening flange 21*a* and inserted into a pump housing 22, and the pump work chamber 12 defined inside the pump cylinder 11 by the pump piston 13 and the pressure valve 18 is connectable, in order to terminate the effective supply stroke that is controlled by the oblique control edge 14*a*, via a stop groove 23 communicating with the recess 14 and via an overflow conduit 24 with a refill reservoir 25 serving as a fuel reservoir. Although a larger volume reservoir is also conceivable as a receptacle for the return-flow fuel quantity, a piston reservoir is used here in order to attain high accuracy in metering the quantity; this piston reservoir has a reservoir chamber 25*a* and a reservoir piston 26 acting as a movable wall, which is displaceable counter to the force of a compression spring 27 serving as a restoring means. A spring chamber 28 containing the spring 27 and disposed on the end of the reservoir piston 26 remote from the reservoir chamber 25*a* communicates via the relief line 29 in a manner not shown in detail with a fuel tank 31.

To enable the adjustment of the cylinder liner 21 both in the direction of its longitudinal axis and with respect to its rotational position as compared with its basic setting, the refill reservoir 25 is connected to the overflow bore 17 by means of a connecting part 32 which permits slight displacements of the cylinder liner 21 with respect to its basic setting, seals the cylinder line 21 against the escape of leaking fuel, and at least partially encompasses the cylinder liner 21. This connecting part 32 is embodied as a slide shoe 32 guided in a radial bore 33 of the pump housing 22 and resting in a positively engaged manner on a cylindrical jacket face 21*b* of the cylinder liner 21. This slide shoe 32 is pressed by a compression spring 34 against the jacket face 21*b* of the cylinder liner 21 and is sealed in the vicinity of this jacket face against the escape of leaking fuel by a sealing ring 35 (see FIG. 1*a*).

Figure 1A:
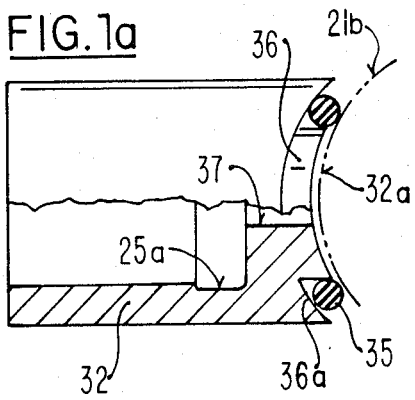
FIGS. 1*a* and 1*b* each show a partially cutaway plan view of two variant embodiments of a slide shoe used in FIG. 1 for the refill reservoir and having an associated sealing ring.

From the larger-scale illustration of the slide shoe 32 with the sealing ring 35 provided in FIG. 1*a*, which shows a partially cutaway plan view of the slide shoe 32, it is clear that an end face 32*a* of the slide shoe 32 resting on the jacket face 21*b*, indicated by dot-dash lines, of the cylinder line 21 is curved to match this jacket face 21*b* and thus, merely by its selected shape, already represents a sealing surface. The sealing ring 35 embodied by an O-ring is received by an end-face groove 36 on the slide shoe 32 and is pressed by an abutment face 36*a* of the end-face groove 36 against the jacket face 21*b*, thereby serving additionally to seal against escaping leaking fuel. The abutment face 36*a* of the end-face groove 36 pressing the sealing ring 35 axially against the jacket face 21*b* is embodied such that it follows the curved end face 32*a* of the slide shoe 32, with a constant spacing apart from the jacket face 21*b*. As may be seen in FIG. 1, the slide shoe 32 is embodied as a reservoir housing that receives the reservoir piston 26 and the reservoir chamber 25*a* of the refill reservoir 25, and the reservoir chamber 25*a* (see FIG. 1*a*) communicates via a connecting bore 37 with the overflow bore 17 and thus, like the overflow bore 17, represents a portion of the overflow conduit 24. The overflow bore 17 embodying one essential part of the overflow conduit 24 is designed to be as short in length as possible, and its optimal length is defined by a minimum wall thickness of the cylinder liner 21 such as to preclude deformation of this cylinder line 21. The contour of the end-face groove 36 on the slide shoe 32 that follows the jacket face 21*b* is advantageously generated by a chip-free process, for instance by extrusion molding of the entire slide shoe 32 or by fabricating the slide shoe 32 as a sintered-steel part.

Figure 1B:
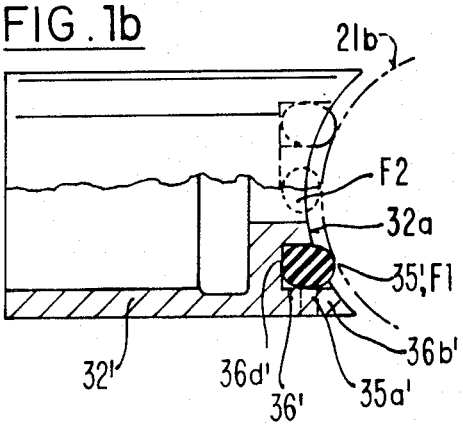

In FIG. 1*b*, a slide shoe 32' is shown as a variant of the slide shoe 32 of FIG. 1; an annular-groove-like end-face groove 36' is cut into the end face 32*a'* of this slide shoe 32' that is adapted to the jacket face 21*b* of the cylinder liner 21. This end-face groove 36' has an abutment face 36*a'* extending at right angles to the longitudinal axis of the slide shoe 32' and embodied as a flat ring face; this abutment face 36*a'* is cut into the end face 32*a'* in a simple manner. The associated sealing ring 35' has annular cross sections $F_1$ and $F_2$ of different widths, adapted to the curved end face 32*a'* of the slide shoe 32' and to the jacket face 21*b* of the cylinder liner 21. To assure that this sealing ring 35' remains in the position shown, it is placed with an outwardly pointing protrusion 35*a'*, shown in dashed lines, into a corresponding recess 36*a'* cut into the end face 32*a'* of the slide shoe 32' and is thus secured against twisting.

An electromagnetically actuatable metering valve 38, embodied as a magnetic valve, is inserted in a pressure-tight manner into a receiving bore 39 of the pump housing 22 diametrically opposite from the refill reservoir 25. This metering valve 38 supplies the pump work chamber 12, via the inflow bore 16, with fuel pumped from a low-pressure source 41 and with its opening duration (b in FIG. 6) determines a fuel injection quantity that is pre-stored in the pump work chamber 12.

The low-pressure source 41 contains a feed pump 42, which aspirates the fuel from the fuel tank 31 and pumps it into the pump work chamber 12 via an inflow line 43, the metering valve 38 and the inflow opening 16 when the pump piston 13 is in its bottom dead center position UT shown in FIG. 1.

In order to establish a connection between the metering valve 38 and the inflow bore 16 that is sealed against the escape of leaking fuel, a mouthpiece 38*a* of the metering valve 38 is received by a second slide shoe 44. This slide shoe 44 is inserted into a radial bore 45 of the pump housing 22 that is located approximately opposite the bore 33 and is urged in the vicinity of the inflow opening 16 against the cylindrical jacket face 21*b* of the cylinder liner 21 by means of a compression spring 46.

For correcting or adjusting the end of the effective supply stroke of the pump piston 13, the fuel injection pump 10 is equipped with an adjusting device 47, which in a known manner comprises a longitudinally displaceable regulating rod 48 and a steering sheath 49 for the pump piston 13 that is actuatable by the regulating rod 48. Both parts 48 and 49 of the adjusting device 47 serve, upon a longitudinal movement of the regulating rod 48 effected by means of an adjusting member 51, to cause the rotation of the pump piston 13, as a result of which the relative position between the overflow opening 17*a* and the oblique control edge 14*a* on the pump piston 13 varies.

The adjusting member 51 actuating the regulating rod 48, as an electromechanical adjusting member, is embodied by an electromagnet, an electric servomotor or an electrohydraulic adjusting member, depending on the adjusting force required, and it receives its control pulse $I_{FB}$, which is dependent on at least one operating characteristic, such as the load L or the rpm n, from an electric control unit 52. The change in the rotational position of the oblique control edge 14*a* attainable with the adjusting device 47, and thus the change in the end of supply, does not, however, in this case determine the fuel injection quantity $Q_E$, but serves instead, in combination with the function of the refill reservoir described in detail above, to vary the instant of supply onset. The position of the adjusting member 51 at a given time is measured by an adjusting-path transducer 53 and fed to the control unit 52 in the form of an adjusting-path signal $S_S$.

With its opening duration, the metering valve 38 embodied as a magnetic valve determines a fuel injection quantity pre-stored in the pump work chamber 12, which quantity corresponds exactly to the fuel quantity $Q_E$ that is to be injected. The magnetic valve 38, embodied in a known manner as a 2/2-way valve, receives a metering pulse $I_Z$ that determines its opening duration from the control unit 52, which contains an electronic regulating circuit, and into which in addition to an rpm signal n emitted by an rpm transducer 54, additional signals dependent on engine operating characteristics are also fed, such as a temperature signal T derived from a suitable location and further signals S. A load signal L to be fed in by a person operating the engine is generated by a set-point value feed means 55.

The fuel metering controlled by the magnetic valve 38 is effected at a constant fuel inflow pressure $p_Z$ via a constant inflow cross section, embodied for instance by the inflow opening 15, at a variable opening duration of the magnetic valve 38 determined by the metering pulse $I_Z$. The constant inflow cross section may also be embodied by the flowthrough cross section of the magnetic valve 38. The constant inflow pressure $p_Z$ is maintained by means of a pressure regulating valve 56 located in the low-pressure source 41. The metering pulse $I_Z$ determining the opening duration thus results in an accurate supply quantity signal.

Figure 2:
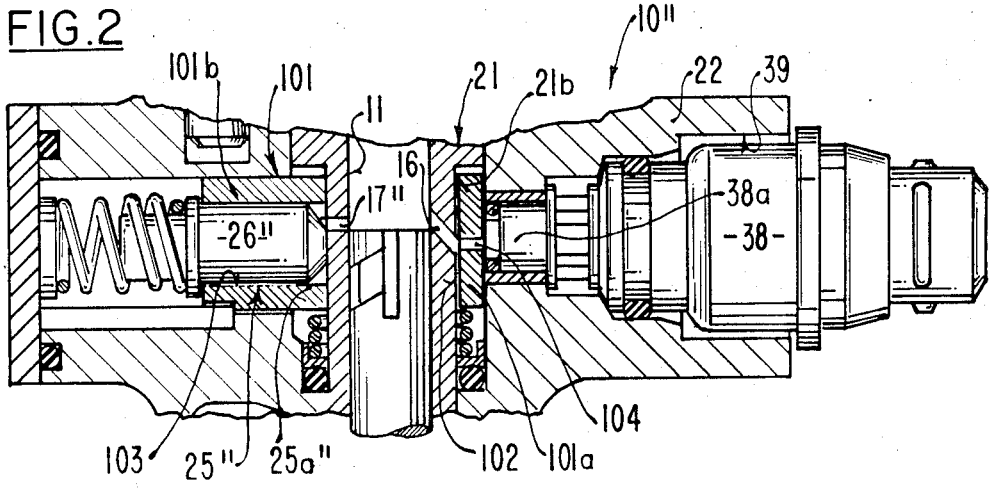
FIG. 2 is a partial cross section through the components of a fuel injection pump that are essential to the invention, in terms of a second exemplary embodiment.

In the second exemplary embodiment, shown in part in FIG. 2, of a fuel injection pump 10″ of the fuel injection apparatus according to the invention, the sole difference from the fuel injection pump 10 shown in FIG. 1 is the differing manner in which the refill reservoir 25″ and metering valve 38 are mounted. Identical elements are therefore identified by the same reference numerals, while differing elements have the same reference numeral with a double prime, and new parts are identified by a reference number higher by 100 than that of their counterparts in FIG. 1. (In further exemplary embodiments, the reference numerals are correspondingly given triple and quadruple primes.)

Serving as a connecting part for the refill reservoir 25″ with the cylinder liner 21 is a connection bracket 101 pushed onto the cylindrical part 21*b* containing an overflow bore 17″ as well as the inflow opening 16. With a transverse bore 102 passing through one end 101*a*, this connection bracket 101 surrounds the cylindrical part 21*b* of the cylinder lining 21 with a close element fit preventing the escape of leaking fuel and furthermore has a longitudinal bore 103 that is radial with respect to the longitudinal axis of the pump cylinder 11. The longitudinal bore 103 discharges into the transverse bore 102 and is cut into the connection bracket 101 from the direction of the other end 101*b* thereof. This longitudinal bore 103 contains the reservoir chamber 25*a″* of the refill reservoir 25″ as well as the latter's reservoir piston 26″. In the wall of its end 101*a* containing the transverse bore 102 the connection bracket 101 furthermore has an inflow bore 104 located diametrically opposite the longitudinal bore 103 and communicating with the inflow opening 16 in the pump cylinder 11. The metering valve 38 inserted into the receiving bore 39 of the pump housing 22 is pressed, in the mounted position shown, in a fuel-tight manner against a wall area of the connection bracket containing the inflow bore 104. Additional sealing means, not identified in detail, are intended to prevent an escape of leaking fuel. The overflow conduit 17″ alone here embodies the overflow conduit, as a result of which a very small idle volume is attainable in a particularly advantageous manner.

Figure 3:
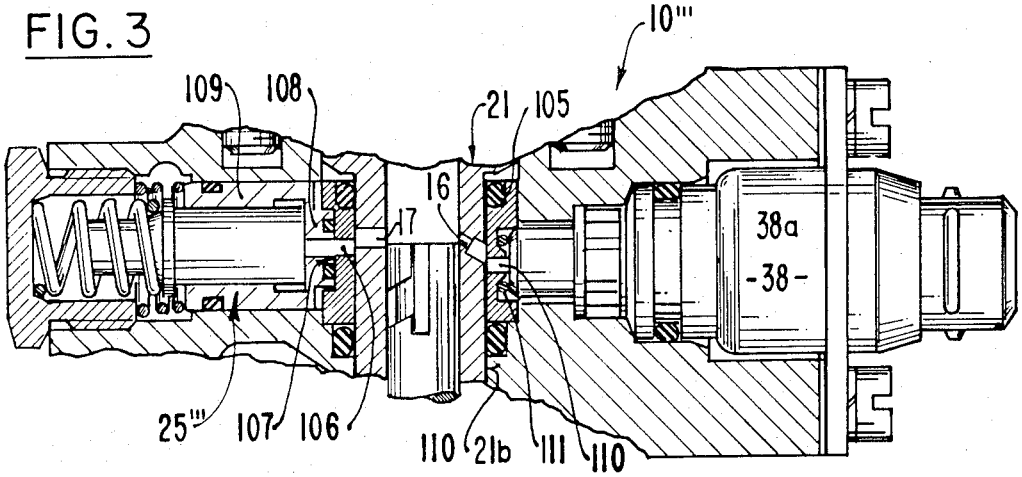
FIG. 3 is a partial cross section similar to FIG. 2, but for the third exemplary embodiment.

In the third exemplary embodiment shown in FIG. 3, the connecting part for the refill reservoir 25‴ of the fuel injection pump 10‴ is embodied as a fitting sheath 105 narrowly encompassing the cylindrical jacket face 21*b* of the cylinder liner 21 in the vicinity of the overflow bore 17. The fitting sheath 105 has a radial through bore 106 communicating with the overflow bore 17 and in a larger diameter bore 107 receives a connection socket 108 of a cylindrical housing 109 of the refill reservoir 25‴. Also contained in the fitting sheath 105 is a second radial through bore 110 communicating with the inflow opening 16 of the cylinder liner 21; in a large diameter bore 111 this through bore 110 receives the mouthpiece 38*a* of the metering valve 38. The through bore 110 is placed at a lower level as compared with the inflow opening 16, in order to prevent vapor bubbles from collecting in the vicinity of the inflow conduits.

Figure 4:
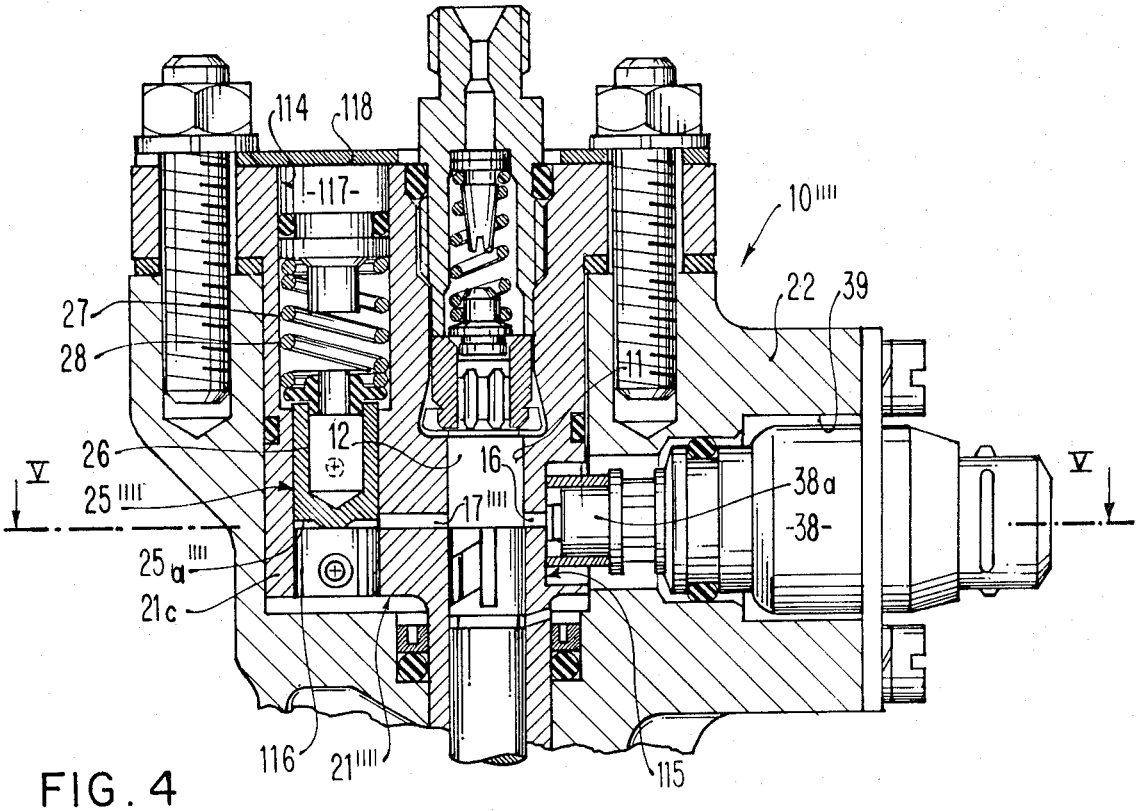
FIG. 4 is a cross section, shown only in part, taken through the fourth exemplary embodiment.

The fourth exemplary embodiment shown in part in FIG. 4 is provided with a cylinder liner 21″ containing the pump cylinder 11 and inserted into the pump housing 22; in a head part 21*c* that is extended on one side, the cylinder liner 21⁗ receives the refill reservoir 25⁗, embodied as a piston reservoir, in a longitudinal bore 114 parallel to the pump cylinder 11. Both the reservoir chamber 25a'''' and the spring chamber 28 receiving the compression spring 27, which acts as the restoring means, are embodied by segments of the longitudinal bore 114. The metering valve 38 inserted into the radial receiving bore 39 of the pump housing 22 is pressed, in the illustrated horizontal mounting position, with the mouthpiece 38a against a sealing face 115, through which the inflow bore 16 passes, on the jacket face of the head part 21c of the cylinder liner 21'''' and is additionally secured against escaping leakage fuel by a seal not shown in detail. The reservoir chamber 25a'''' defined inside the longitudinal bore 104 at one end by the reservoir piston 26 is sealed off from the outside by a sealing plug 116. The opposite end of the longitudinal bore 114 receiving the spring chamber 28 is closed with a second sealing plug 117, which at the same time is embodied as a spring support for the compression spring 27. A pressure plate 118 secured simultaneously with the cylinder liner 21'''' on the pump housing 22 holds the sealing plug 117, which is inserted with a sliding fit, in its illustrated mounting position. Serving here as the overflow conduit connecting the pump work chamber 12 with the reservoir chamber 25'''' is an overflow bore 17'''' located diametrically opposite the inflow opening 16 and drilled through the opening 16 and on into the head part 21c of the cylinder liner 21''''.

Figure 5:
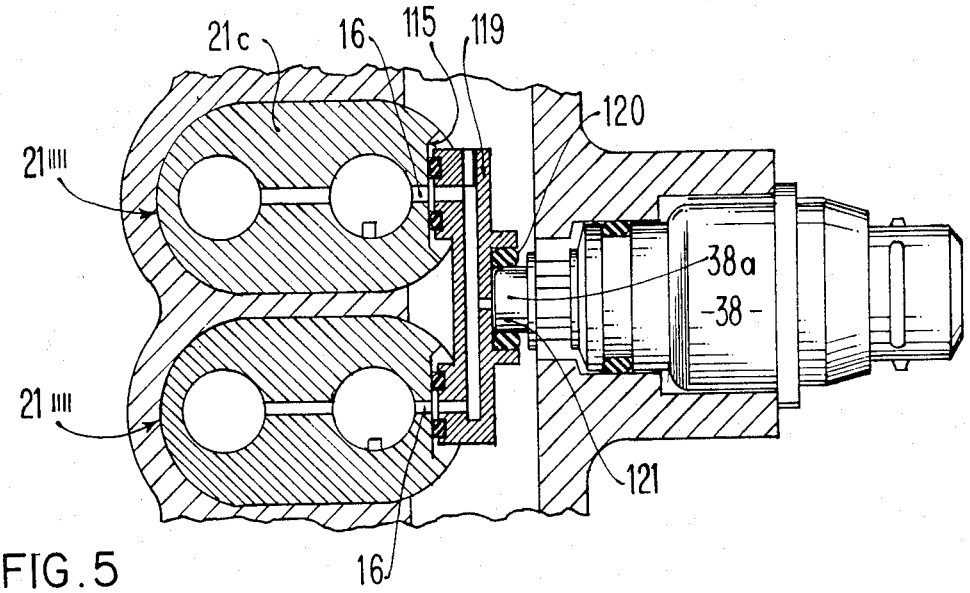
FIG. 5 is a section at the level of line V—V of FIG. 4, but taken through a variant of the fourth exemplary embodiment having only one magnetic valve for two pumping elements.

The variant shown in FIG. 5 of the fourth exemplary embodiment shown in FIG. 4 is shown in a longitudinal section along the line V—V of FIG. 4, but for a modification in which two pump cylinders 21'''' at a time are supplied with the fuel injection quantity that is to be pre-stored by means of a single metering valve 38. As is clearly shown in FIG. 5, the inflow openings 16 of two cylinder liners 21'''' at a time are connected via a suspension-bridge-like connecting part 119 to a single metering valve 38. This connecting part 119 is pressed by the tensioning force of the metering valve 38 against the sealing faces 115 on the jacket face of the given head part 21c of the cylinder liners 21'''', and the mouthpiece 38a of the metering valve 38 is received by a recess 121 in the connecting part 119, the recess 121 being sealed off from the outside by means of a sealing ring 120.

Figure 6:
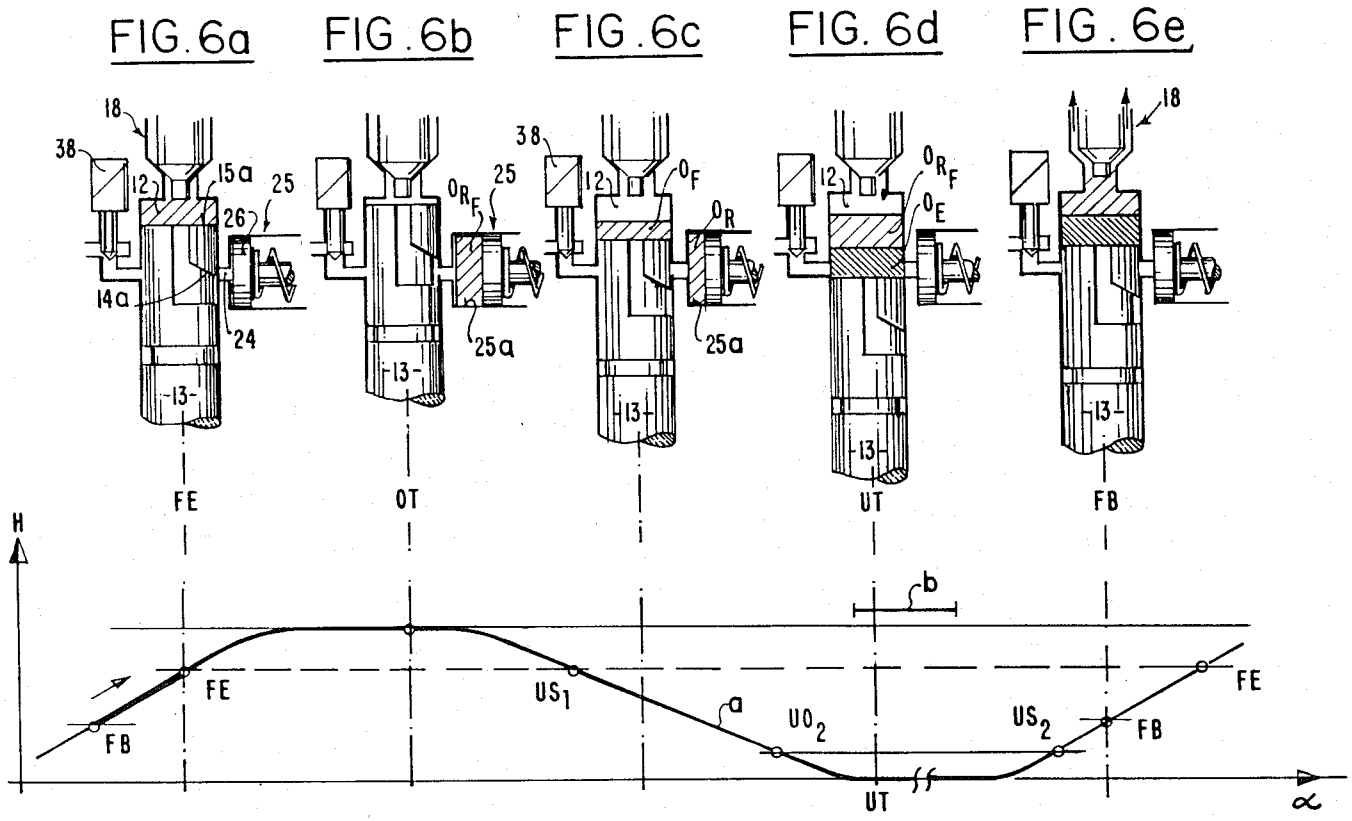
FIG. 6 is a function diagram for the piston stroke, with subdiagrams FIGS. 6a–6e showing the respective positions of the piston, refill reservoir, metering valve and pressure valve and the associated fill status in the pump work chamber and the refill reservoir.

The diagram shown in FIG. 6 shows a curve a representing the piston stroke H plotted over the cam angle $\alpha$ and includes sub-FIGS. 6a–6e in which the position at a given time of the pump piston 12, the reservoir piston 26, the metering valve 38 and the pressure valve 18, as well as the fill status at a given time in the pump work chamber 12 are all shown in simplified form. The piston stroke H is plotted to a double-size scale, while the cam angle $\alpha$ is plotted not to scale because of the associated FIGS. 6a–6e. A horizontal bar b shown in the vicinity of bottom dead center UT above the curve a represents the opening duration of the metering valve 38. The points for the supply onset FB and end of supply FE as well as the points $US_1$ and $UO_2$, standing respectively for the instant when the overflow conduit 24 is closed by the oblique control edge 14a and for the instant when this overflow conduit 24 is opened by the horizontal control edge 15a, are plotted on the curve a. The instant of closing of the overflow conduit 24 by the horizontal control edge 15a located after UT is represented by $US_2$, while the instant when this conduit 24 is opened by the oblique control edge 14a occurs simultaneously with the end of supply at point FE. The associated positions of the pump piston 13 are again shown for FIGS. 6a, 6b, 6d and 6e below the piston 13. In FIG. 6c, the pump piston 13 assumes a position between the closing instant $US_1$ and the opening instant $UO_2$, and the fill status shown in the pump work chamber 12 and the reservoir chamber 25a is already attained shortly after $US_1$. The entire return-flow fuel quantity $Q_{RF}$ as well as a partial quantity $Q_F$ of $Q_{RF}$ and a remnant quantity $Q_R$ are shown by shading, and the fuel injection quantity $Q_E$ metered by the metering valve 38 is shown by double shading.

The mode of operation of the subject of the application will now be described with the aid of FIGS. 1 and 6 in terms of the first exemplary embodiment. The exemplary embodiments shown in FIGS. 2–5 function in the same manner and differ only in their structural details.

In FIG. 1, the pump piston 13 is shown in its bottom dead center position UT corresponding to FIG. 6d, and the entire return-flow fuel quantity $Q_{RF}$ and the fuel injection quantity $Q_E$ pre-stored by the metering valve 38 are contained in the partially evacuated pump work chamber 12. After the horizontal control edge 15a has closed the inflow opening 16 and, at $US_2$, the overflow conduit 24 as well, the onset of supply is initiated at FB during the further upward stroke of the pump piston 13. The injection takes place until point FE, with the pressure valve 18 permitting the flow of fuel to the injection nozzle (see FIG. 6e). The end of supply FE is controlled by the opening of the overflow conduit 24 by the oblique control edge 14a (see FIG. 6a), and up to top dead center OT the pump piston 13 positively displaces the entire return-flow fuel quantity $Q_{RF}$, (the pressure valve 18 being closed), into the reservoir chamber 25a of the refill reservoir 25 (see FIG. 6b). During the return or aspiration stroke of the pump piston 13, until the closure of the overflow conduit 24 by the oblique control edge 14a, a partial quantity $Q_F$ of the return-flow fuel quantity $Q_{RF}$ is refilled or re-aspirated into the pump work chamber 12. Because of the differing compression volume at the end of supply and during the intake stroke, a remnant quantity $Q_R$ remains in the reservoir chamber 25a (see FIG. 6c). This remnant quantity $Q_R$ is refilled into the pump work chamber 12 after the opening instant $UO_2$ of the overflow conduit 24 and until bottom dead center UT of the pump piston 13, so that at UT the entire return-flow fuel quantity $Q_{RF}$ is again present and available in the pump work chamber 12. In the range between $UO_2$ and $US_2$, and if possible at UT, the fuel injection quantity $Q_E$ is prestored into the pump work chamber 12 during the opening period of the metering valve 38 that is defined by the metering pulse $I_Z$ of the control unit 52 and indicated at b in FIG. 6. Between US and FB, a partial vacuum remaining in the pump work chamber 12 is compressed, and the subsequent fuel injection then begins at FB (see FIG. 6e).

The control of the end of supply FE by the corresponding rotational position of the oblique control edge 14a or by the change in rotational position of the pump piston 13 by means of the adjusting movement of the regulating rod 48 effected by means of the electromechanical adjusting member 51 determines the instant of supply onset FB by means of the return-flow fuel quantity $Q_{RF}$ that is diverted and then refilled. If the opening duration of the metering valve 38 controlled by the metering pulse $I_Z$ of the control unit 52 is varied, then the adjusting member 51 is also followed up, by means of an appropriate correcting pulse of the control unit 52, at an appropriately adapted adjusting speed and the return-flow fuel quantity is corrected, so that the instant of supply onset FB remains constant. If however the instant of supply onset FB is to be varied in accordance with the rpm n or the load L or other operating characteristics, while the injection quantity $Q_E$ remains the same, then all that is done is that a different rotational position of the pump piston 13 is established by means of the adjusting device 47. For precise regulation of this rotational position, the adjusting member 51 is provided with the adjusting-path transducer 54, which emits an adjusting-path signal $S_S$ to the electrical control unit 52; this transducer 54 is merely suggested in FIG. 1 and may be disposed an any arbitrary location, for instance on the regulating rod 48 instead, and embodied by a known travel-path transducer operating capacitively, inductively or in some other manner.

The fuel injection apparatus described in terms of four exemplary embodiments and provided with a series injection pump may also contain, instead of the fuel injection pump 10, 10'', 10''' or 10'''', a pump/nozzle that has been combined into a modular unit with the injection nozzle. The operational principle of the fuel injection apparatus according to the invention can also be applied, being adapted accordingly, to distributor injection pumps.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection apparatus for internal combustion engines, having at least one pump piston guided in an axially and rotationally movable manner in a pump cylinder of a fuel injection pump and defining a pump work chamber between said pump piston and a supply valve, the pump piston being provided with first and second control locations axially offset from one another along said piston, said first control location embodied as an oblique control edge and in order to terminate an effective supply stroke opens an overflow opening disposed separately from an inflow opening in the pump cylinder and upon a return stroke of the pump piston enables a refilling of a return-flow fuel quantity diverted from said chamber following the end of supply;

a fuel reservoir connectable with the pump work chamber via said overflow opening and an overflow conduit;

an adjusting device that serves to shift the instant of supply onset by means of rotating the pump piston and is provided with an electromechanical adjusting member;

an electromechanically actuatable metering valve for supplying the pump work chamber via the inflow opening with fuel pumped from a source of low pressure, said metering valve, with its opening duration, determining a fuel injection quantity prestored in the pump work chamber;

an electric control unit, which emits control pulses ($I_{FB}$, $I_Z$) dependent on operating characteristics (n, T, $S_S$, S) both to the piston adjusting member and to the metering valve;

said fuel reservoir embodied as a refill reservoir, said refill reservoir includes a reservoir chamber and a reservoir piston, said reservoir piston including a bottom facing towards said pump work chamber and filling an end portion of said reservoir chamber facing said pump work chamber when in its nondisplaced position and being displaceable counter to a force of a restoring means in which said reservoir chamber receives an entire return-flow fuel quantity diverted after the end of supply and returning this quantity back into the pump work chamber prior to the next subsequent supply stroke, said overflow condiit representing the sole and direct connection between the refill reservoir and the pump work chamber, and that said overflow opening is located at the discharge location of the overflow conduit into the pump work chamber and is openable by said first and second control locations of the pump piston.

2. A fuel injection apparatus as defined by claim 1, in which the overflow opening is openable at the end of the effective supply stroke by the oblique control edge of said first control location of the pump piston and enables an outflow of the return-flow fuel until a reversal of axial movement of the pump piston and upon the return stroke permits a refilling until the closure of the overflow opening, in which the overflow opening is repeatedly openable, shortly before the end of the intake or return stroke of the pump piston, by said second control location and assures a refilling of a remnant quantity of the return-flow fuel still remaining in the refill reservoir.

3. A fuel injection apparatus as defined by claim 1, having a cylinder liner, containing the pump cylinder and secured in the pump housing, and an overflow bore in a wall of the cylinder liner forming at least a substantial portion of the overflow conduit, in which the optimal length of the overflow bore is fixed by the minimum wall thickness of the cylinder liner precluding a deformation of the cylinder liner.

4. A fuel injection apparatus as defined by claim 3, in which the refill reservoir is connected to the overflow bore by means of a connecting part which at least partially surrounds the cylinder liner and which permits slight displacements of the cylinder liner relative to its basic setting and being sealed against the escape of fuel leakage.

5. A fuel injection apparatus as defined by claim 4, in which the connecting part is embodied as a slide shoe guided in a radial bore of the pump housing and resting in a positively-engaged manner on a cylindrical jacket face of the cylinder liner.

6. A fuel injection apparatus as defined by claim 5, in which the slide shoe is simultaneously embodied as a reservoir housing receiving the reservoir piston and the reservoir chamber of the refill reservoir.

7. A fuel injection apparatus as defined by claim 5, in which a second slide shoe receiving a mouthpiece of said metering valve is disposed in a second radial bore of the pump housing and is clamped in the vicinity of said inflow opening against the cylindrical jacket face of the cylinder liner.

8. A fuel injection apparatus as defined by claim 5, in which an end face of the slide shoe resting on the jacket face of the cylinder liner is curved such as to correspond with this jacket face and is sealed against the escape of fuel leakage by means of a sealing ring that is received by an end-face groove on the slide shoe and is pressed against the jacket face.

9. A fuel injection apparatus as defined by claim 8, in which an abutment face of the end-face groove pressing the sealing ring axially against the jacket face is embodied such that it follows the curved end face of the slide shoe at a constant distance from the jacket face.

10. A fuel injection apparatus as defined by claim 8, in which an abutment face of the end-face groove axially supporting the sealing ring is embodied as a flat annular face, and the sealing ring has annular cross sections of different widths that are adapted to the curved end face of the slide shoe and to the jacket face of the cylinder liner.

11. A fuel injection apparatus as defined by claim 4, in which the connecting part is embodied as a fitting sheath narrowly surrounding a cylindrical jacket face of the cylinder liner in the vicinity of the overflow bore, the fitting sheath having at least one radial through bore communicating with the overflow bore, which radial through bore, in a larger bore, receives a connection socket of a cylindrical housing of the refill reservoir.

12. A fuel injection apparatus as defined by claim 11, in which the fitting sheath contains a second radial through bore communicating with the inflow opening of the cylinder liner, which second radial through bore in a larger bore receives a mouthpiece of the metering valve.

13. A fuel injection apparatus as defined by claim 4, in which the connecting part is embodied as a connection bracket surrounding a cylindrical jacket face of the cylinder liner located in the vicinity of the overflow bore, said connection bracket including a transverse bore which passes through one of its ends, and narrowly surrounds the cylinder liner and has a longitudinal bore that is radial relative to the longitudinal axis of the pump cylinder said longitudinal bore discharges into the transverse bore, and is cut into the connection bracket from the direction of its other end, said longitudinal bore receiving the reservoir chamber of the refill reservoir as well as the reservoir piston thereof.

14. A fuel injection apparatus as defined by claim 13, in which the connection bracket has an inflow bore in the wall of its end containing the transverse bore the inflow bore being located diametrically opposite the longitudinal bore and communicating with the inflow opening in the pump cylinder, and that the metering valve is inserted into the pump housing such that a mouthpiece presses in a fuel-tight manner against a wall area containing the inflow bore of the connection bracket.

15. A fuel injection apparatus as defined by claim 1, comprising a cylinder liner containing the pump cylinder and inserted into the pump housing and an overflow bore embodying the overflow conduit, in the pump cylinder of the cylinder liner, in which the refill reservoir embodied as a piston reservoir is disposed inside a head part, widened at one end, of the cylinder lining in a longitudinal bore parallel to the pump cylinder, wherein both the reservoir chamber and a spring chamber receiving a compression spring acting as the restoring means are formed by sections of this longitudinal bore and that the metering valve is inserted into a radial receiving bore of the pump housing and is clamped with a mouthpiece directly or indirectly against a sealing face penetrated by the overflow opening on the jacket face of the head part of the cylinder liner.

16. A fuel injection apparatus as defined by claim 15, in which the inflow openings of two adjacent cylinder liners are connected via a connecting part to a single metering valve.

* * * * *